United States Patent [19]

Verweel

[11] 4,135,111

[45] Jan. 16, 1979

[54] SHADOW MASK HAVING MAGNETIC QUADRUPOLES AROUND EACH MASK APERTURE

[75] Inventor: Jan Verweel, Eindhoven, Netherlands

[73] Assignee: U.S. Philips Corporation, New York, N.Y.

[21] Appl. No.: 751,368

[22] Filed: Dec. 16, 1976

[30] Foreign Application Priority Data

Dec. 24, 1975 [NL] Netherlands ..... 7515039

[51] Int. Cl.[2] ..... H01J 29/07; H01J 31/20

[52] U.S. Cl. ..... 313/403; 313/408

[58] Field of Search ..... 313/402, 403, 408

[56] References Cited

U.S. PATENT DOCUMENTS

| | | | |
|---|---|---|---|
| 2,717,323 | 9/1955 | Clay | 313/412 |
| 2,972,073 | 2/1961 | Clay | 313/412 |
| 3,136,910 | 6/1964 | Kaplan | 313/329 X |
| 3,354,336 | 11/1967 | Rennick | 313/412 |
| 4,059,781 | 11/1977 | Van Alphen et al. | 313/403 |

*Primary Examiner*—Robert Segal

*Attorney, Agent, or Firm*—Algy Tamoshunas

[57] ABSTRACT

A cathode ray tube for displaying colored pictures of the post focusing type. A magnetic quadrupole lens is formed in each aperture of the color selection means. The defocusing direction of quadrupole lenses is parallel to the phosphor strips of the display screen.

7 Claims, 8 Drawing Figures

SHADOW MASK HAVING MAGNETIC QUADRUPOLES AROUND EACH MASK APERTURE

The invention relates to a cathode ray tube for displaying colour images and comprising in an evacuated envelope means to generate a number of electron beams, a display screen comprising a large number of regions luminescing in different colours, and colour selection means comprising a large number of apertures which allow each electron beam to reach luminescent regions of only one colour, in which colour selection means a magnetic field is generated to form an electron lens in each aperture.

Such a cathode ray tube of the postfocussing type is known from U.S. Pat. No. 3,136,910. The object of postfocusing is to increase the brightness of the displayed picture by increasing the transmission of the colour selection means. In tubes without postfocusing a very great part, for example 80 to 85%, of the electrons is intercepted by the so-called shadow mask. By the use of postfocusing the aperture in the colour selection means can be enlarged since, as a result of the focusing in the apertures, the electron spots on the screen are considerably smaller than the apertures so that the inspite of the increased size of the apertures there is sufficient space between the electron spots of the various electron beams.

The electron lens formed in the apertures of the shadow mask of the known tube is of the axial-symmetric type so that essentially a very strong magnetization over a certain length is necessary to form a lens of a sufficient strength.

It is the object of the invention to provide a cathode ray tube for displaying coloured pictures of the kind mentioned in the preamble in which a focusing of a sufficient strength is obtained with a comparatively small magnetization.

For that purpose, according to the invention a magnetic quadrupole lens is formed in each aperture of the colour selection means.

Since the magnetic field is at right angles to the electron path, quadrupole lenses are comparatively very strong so that a much smaller magnetization will suffice. That a quadrupole lens focuses in one direction and defocuses in a direction at right angles thereto is in principle no objection when all the quadrupoles have the same orientation. Therefore, the luminescent regions of the display screen preferably are in the form of substantially parallel strips the longitudinal direction of which is substantially parallel to the defocusing direction of quadrupole lenses.

In a suitable embodiment of the tube according to the invention the colour selection means are formed by a grid consisting of two sets of parallel strips of soft magnetic material crossing each other, which strips are linked at the crossings by means of discs of permanent magnetic material the directions of magnetization of which have the same general direction at right angles to the plane of the grid.

In another suitable embodiment of the invention the colour selection means are formed by a ferromagnetic plate which comprises the said apertures which plate is magnetized so that four magnetic poles are arranged along the edge of each aperture in the following, equally spaced order a north pole, a south pole, a north pole, and a south pole.

The colour selection means may alternatively be formed by a non-ferromagnetic plate which is provided with the apertures and with a layer of magnetizable material, which layer is magnetized so that there is the same arrangement of magnetic poles along the edge of each aperture a north pole, a south pole, a north pole, and a south pole.

The invention will be described in greater detail with reference to the accompanying drawing, of which:

FIG. 1 shows a cathode ray tube for displaying coloured pictures according to the invention;

FIG. 2 explains the focusing by means of a magnetic quadrupole lens;

FIG. 3 serves to explain the principle of the invention;

Figure 7:
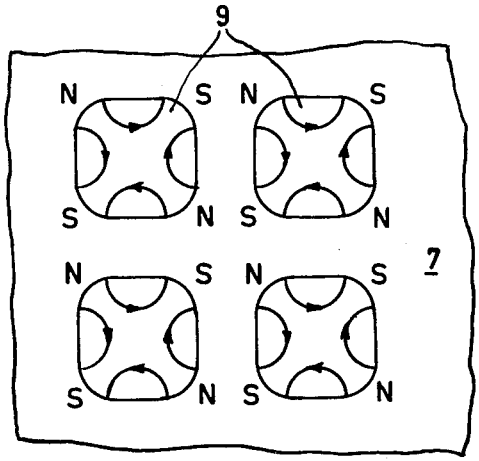
FIG. 7 shows a second embodiment of a tube according to the invention.
Figure 8:
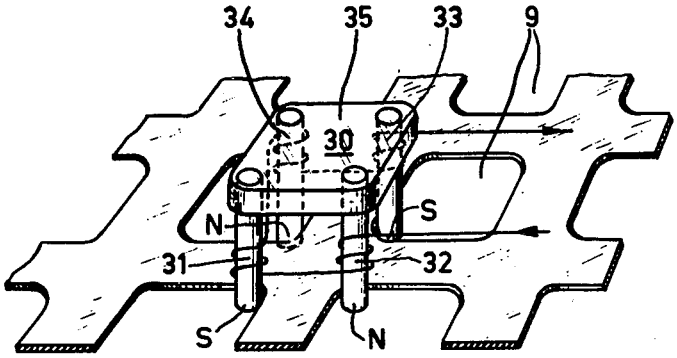

FIG. 8 explains a method of manufacturing the embodiment shown in FIG. 7.

Figure 1:
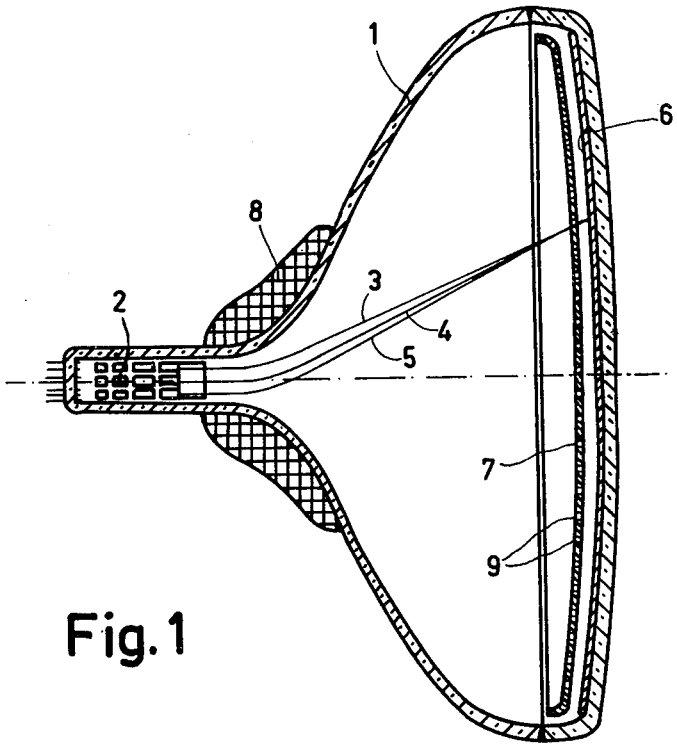

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue and the longitudinal direction of which is at right angles to the plane of the drawing of FIG. 1. During normal operation of the tube the phsphor strips are vertical and FIG. 1 hence is a horizontal sectional view of the tube. The colour selection means 7, which will be described in greater detail with reference to FIGS. 3, 4 and 6, comprise a large number of apertures 9 which are shown only diagrammatically in FIG. 1. The three electron beams 3, 4 and 5 pass through the apertures 9 at a small angle with respect to each other and consequently each impinge only upon phosphor strips of one colour. The apertures 9 in the colour selection means 7 are thus very accurately positioned relative to the phosphor strips of the display screen 6.

In the shadow mask tube currently generally used the electron beams 3, 4 and 5 are not focused while passing through the apertures 9. In the previously mentioned U.S. Pat. No. 3,136,910, axialsymmetric magnetic lenses to focus the electron beams are formed in the apertures 9.

Figure 2:
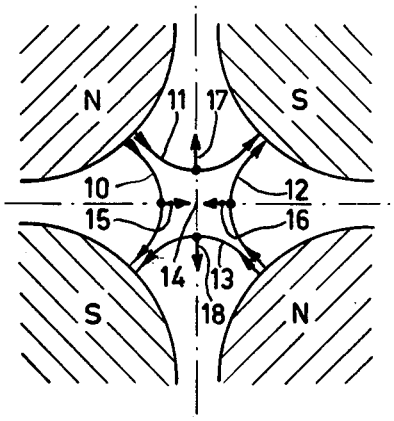

According to the present invention, a magnetic quadrupole lens is formed in each aperture. The known principle of a magnetic quadrupole lens is explained again with reference to FIG. 2. Four magnetic poles which cyclically are magnetized north, south, north, south (N-S-N-S) form a magnetic field of which a few field lines 10, 11, 12 and 13 are shown. An electon beam the axis of which coincides with the axis 14 of the quadrupole lens and the electrons of which more into and perpendicularly into the plane of the drawing, is subjected to the focusing and defocusing forces denoted by the arrows 15, 16, 17 and 18. The cross-section of the electron beam is thus expanded in the vertical direction and is made narrower in the horizontal direction.

Figure 3:
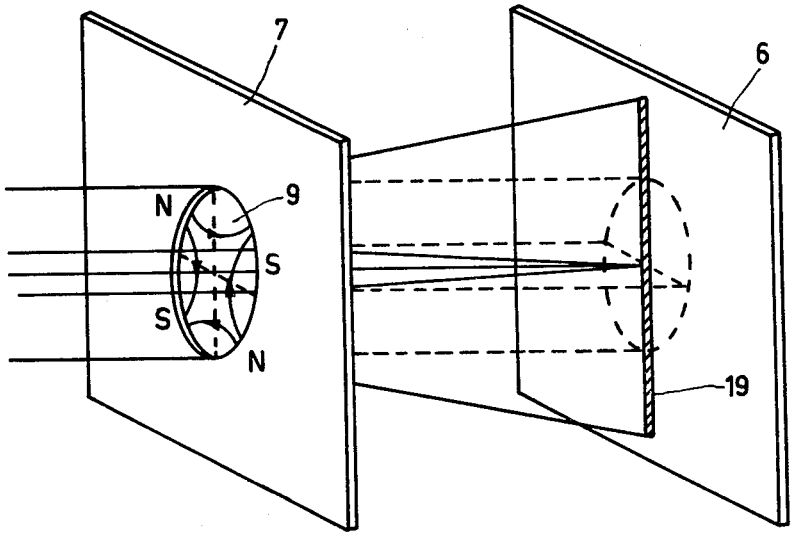

FIG. 3 shows such a magnetic quadrupole lens diagrammatically in an aperture 9 of the colour selection means 7. The variation of the magnetization along the perimeter of the aperture 9 is denoted by N, S, N, S in such manner that a quadrupole field is formed. The electron beam which passes through the aperture 9 is focused in the horizontally drawn plane and is defocused in the vertically drawn plane so that, when the display screen is exactly in the horizontal focus, the electron spot 19 is formed. As will be explained hereinafter it is preferable not to focus the beam exactly on the display screen 6 so that a slightly wider electron spot is obtained. The fact that the electron beams, pass through the aperture 9 at a small angle to obtain the desired colour selection of the three electron beams 3, 4 and 5 in a manner quite analogous to that in the known shadow mask tube causes only a minor effect on focusing. Due to the strong focusing, the aperture 9, however, may be much larger than in the known shadow mask tube so that far more electrons impinge upon the display screen 6 and a brighter picture is obtained. The defocusing in the vertical direction need not raise any objection when phosphor strips are arranged parallel to the longitudinal direction of the spot 19. Colour selection means comprising a large number of magnetic quadrupole lenses have been realized in two manners.

Figure 4:
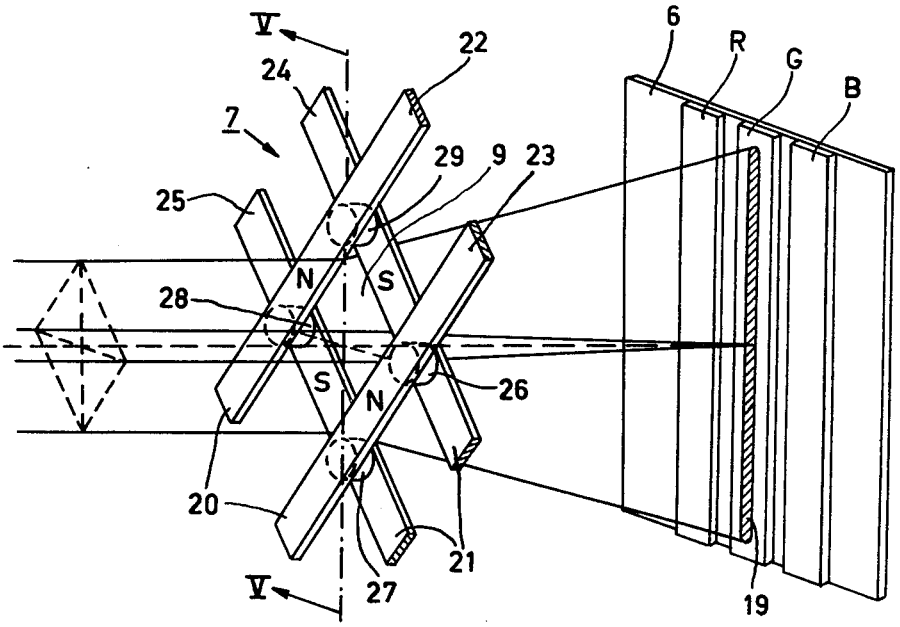
FIGS. 4, 5 and 6 show a first embodiment of a tube according to the invention.
Figure 5:
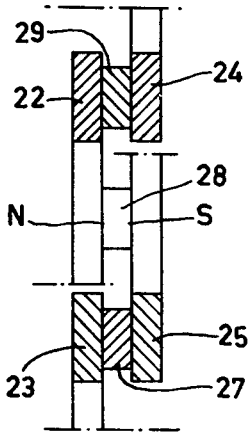
Figure 6:
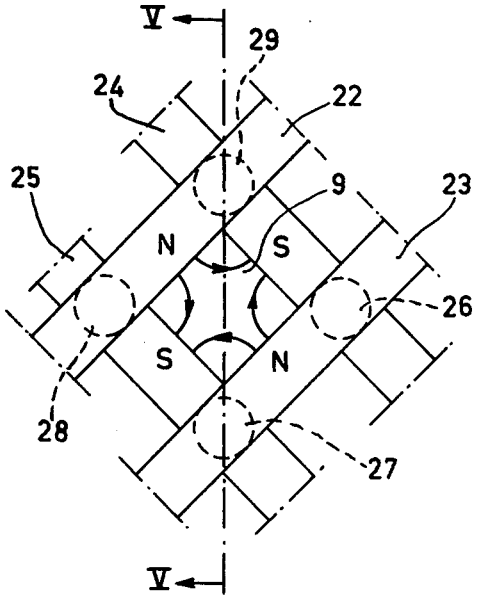

A first embodiment of the present invention will be described with reference to FIG. 4. For further explanation of FIG. 4, FIGS. 5 and 6 are a sectional view of the colour selection means 7 taken on the line V-V of FIG. 4 and an elevation of colour selection means 7 in the direction of the display screen 6, respectively. The colour selection means 7 consist of a grid of two sets 20 and 21 of parallel strips of soft magnetic material crossing each other. The strips are linked at the crossings by means of discs 26, 27, 28 and 29 of permanent magnetic material. The direction of magnetization of all the discs is at right angles to the plane of the grid and in this embodiment is such that the north pole of the discs is directed toward the electron gun and the south pole is directed forward the display screen. Each set of parallel strips 20 and 21 comprises a large number of strips of which in FIG. 4 only the strips 22 and 23 and 24 and 25, respectively, are shown, which define one of the many apertures 9 of the colour selection means 7. The strips 22 and 23 form the north poles and the strips 24 and 25 form the south poles of the quadrupole lens of which a few magnetic field lines are shown again in FIG. 6.

The strips 22, 23, 24, and 25 are of a soft magnetic material, that is to say a material which shows substantially no remanent magnetic after removing an external magnetic field. The material of the strips may consist, for example, of annealed lowcarbon iron or alloys of approximately 75% by weight of nickel and approximately 25% by weight of iron which are commercially available as permalloy and mumetal. The discs 26, 27, 28 and 29 consist of a material having a very strong permanent magnetism for example, the materials available commercially as "Ferroxdure" and "Ticonal". The discs are preferably provided between the strips in a non-magnetized condition after which they can be magnetized simultaneously by means of a homogeneous magnetic field at right angles to the plane of the colour selection means 7.

A second embodiment will be described with reference to FIG. 7. The colour selection means 7 consist of a foil of a permanent magnetic material, for example a steel which can be rolled and etched to form the apertures 9. A suitable material may comprise the following constituents by weight, 20% iron, 20% nickel, and 60% copper or 56% iron, 27% chromium, 15% cobalt, 1% niobium and 1% aluminum. Another example of a suitable material is one which is used for magnetic recording purposes (for example $\gamma$-$Fe_2O_3$ or 90% cobalt and 10% phosphorus or 90% nickel and 10% phosphorus) on a non-ferromagnetic support of, for example, aluminum. The foil is then magnetized in such manner that the magnetic poles denoted in FIG. 7 by N and S are obtained. As will be described with reference to FIG. 8, the magnetization is carried out with a kind of writing head 30 having four pole shoes 31, 32, 33 and 34 which are provided with coils through which an electric current flows in the correct direction. The pole shoes are connected magnetically by a yoke 35. For mass production a multiple writing head may be considered, for example for magnetizing the foil along a line throughout the width of the colour selection means 7.

If, in the embodiment of FIG. 7 the apertures 9 are substantially square but have rounded corners and have dimensions of 0.6 × 0.6 mm, the pitch between the apertures 9 is 0.8 mm, and the thickness of the foil is 0.15 mm, the magnetic field strength in the plane of the foil is maximum 16,000 A/m, and the energy of the electron beam is 25, keV, the focal distance of the quadrupole lenses will be 20 mm. In the case of non-perpendicular incidence of the electron beam (near the corners of the display screen) the focal distance becomes slightly smaller. The distance between the colour selection means 7 and the display screen 6 is 15 mm in the centre and 10 mm at the edge of the display screen, in such manner that the focus of the quadrupole lenses is always slightly behind the display screen, to prevent a so-called focus ring from becoming visible. By causing the magnetization to vary over the colour selection means, a great degree of freedom of the distance between the colour selection means 7 and the display screen 6 can be obtained.

A display screen for a tube according to the invention can be manufactured with a known exposure method in which the colour selection means are reproduced on a photosensitive layer on a faceplate portion of the tube. Because of the large percentage of open area of the colour selection means according to the invention, the exposure method used should reproduce the apertures 9 considerably reduced in size. An exposure method suitable for this purpose uses two or more light sources at some distance from each other as described in German Patent Application 2,248,878. Of course a tube according to the invention may also be made using so-called electronic exposure in which the sensitive layer on the window portion is "exposed" by means of an electron beam. Exposure may also be carried out with small apertures 9 which after the exposure are enlarged by afteretching to the desired dimensions.

What is claimed is:

1. A colour cathode ray tube comprising, in an evacuated envelope: means to generate a plurality of electron beams directed toward a common region along convergent paths; a luminescent screen comprising a large number of luminescent elongated, substantially parallel regions, each emitting light of a predetermined colour in response to being struck by one of said beams; and colour selection means positioned between said beam generating means and said screen and having a plurality of apertures each aligned with respect to said beams to allow each of said beams to strike only those of said regions emitting light of a corresponding colour, said colour selection means comprising magnetized means for producing four magnetic poles of alternately north and south polarity around the perimeter of each of said apertures to form a quadrupole magnetic lens field in each of said apertures for focusing electrons passing therethrough in a direction substantially perpendicular to the longitudinal direction of said elongated regions and defocusing the electrons in a direction substantially parallel to said elongated regions.

2. A cathode ray tube as claimed in claim 1 in which the luminescent regions are in the form of substantially parallel strips.

3. A cathode ray tube as claimed in claim 1 characterized in that the magnetized means comprises a plate of permanently magnetizable material having said apertures said plate being magnetized so that along the perimeter of each aperture there are, in sequence, a north pole, a south pole, a north pole and a south pole defining said quadrupole lens.

4. A cathode ray tube as claimed in claim 1 characterized in that the colour selection means comprises a non-ferromagnetic plate which is provided said apertures and said magnetized means includes a layer of magnetizable material on said plate, which layer is magnetized so that along the perimeter of each aperture there are, in sequence, a north pole, a south pole, a north pole and a south pole defining said quadrupole lens.

5. A cathode ray tube as claimed in claim 1 characterized in that the colour selection means includes a grid comprising two sets of parallel slats of soft magnetic material crossing each other and defining a geometrical surface, and said magnetized means includes discs of permanent magnetic material at the crossing of said slats, the directions of magnetization of said discs being in the same general direction orthogonal to said geometric surface.

6. A cathode ray tube as claimed in claim 5 in which the luminescent regions are in the form of substantially parallel strips, the longitudinal direction of which is substantially parallel to the defocusing direction of the quadrupole lenses, and said slats are oriented at substantially a 45° angle with respect to said strips.

7. A cathode ray tube as claimed in claim 1 in which the magnetized means comprises a sheet of permanently magnetized material having generally square apertures with rounded corners and being magnetized to have four magnetic pole concentration areas at the rounded corners, the magnetic polarities at adjacent corners being mutually opposite, to thereby form a quadrupole lens field in each of said generally square apertures.

* * * * *

UNITED STATES PATENT AND TRADEMARK OFFICE

CERTIFICATE OF CORRECTION

PATENT NO. : 4,135,111

DATED : January 16, 1979

INVENTOR(S) : JAN VERWEEL

It is certified that error appears in the above-identified patent and that said Letters Patent are hereby corrected as shown below:

In the Claims:

Col. 5, line 18, after "which is provided" insert --with--

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*